United States Patent [19]

Hamrick

[11] 4,227,285

[45] Oct. 14, 1980

[54] TEXTILE CARD CLEANING APPARATUS

[76] Inventor: Marvin Hamrick, P.O. Box 603, Rte. 1, Grover, N.C. 28073

[21] Appl. No.: 8,547

[22] Filed: Feb. 2, 1979

[51] Int. Cl.[3] ..... D01G 15/82

[52] U.S. Cl. ..... 19/107

[58] Field of Search ..... 19/107, 98

[56] References Cited

U.S. PATENT DOCUMENTS

| | | | |
|---|---|---|---|
| 2,284,750 | 6/1942 | Landreth | 19/107 |
| 3,204,296 | 9/1965 | Reiterer | 19/107 X |
| 3,438,093 | 4/1969 | Rutz | 19/107 |
| 3,849,837 | 11/1974 | Bass et al. | 19/107 |
| 4,075,732 | 2/1978 | Araki | 19/107 X |

FOREIGN PATENT DOCUMENTS

| | | | |
|---|---|---|---|
| 648333 | 9/1964 | Belgium | 19/107 |
| 1132035 | 6/1962 | Fed. Rep. of Germany | 19/107 |
| 40-26214 | 6/1963 | Japan . | |
| 1512468 | 6/1978 | United Kingdom . | |

*Primary Examiner*—Louis Rimrodt

*Attorney, Agent, or Firm*—Adams & Jenkins

[57] ABSTRACT

A textile card cleaning apparatus is provided which comprises a plurality of suction hoods disposed within the arcuate chamber defined by the continuous belt of flats disposed above the main cylinder of a textile card. The plurality of suction hoods is adapted so as to draw cotton dust and lint both from the arcuate chamber wherein they reside and up between the flats from the working space between the main cylinder of the textile card and the lower operative run of flats adjacent thereto. The cotton dust and lint is then drawn off to a remote location by suction means fluidly communicating with the plurality of suction hoods.

14 Claims, 8 Drawing Figures

TEXTILE CARD CLEANING APPARATUS

BACKGROUND OF THE INVENTION

During the textile carding process in which fiber stock is fed to the card in either loose form or in the form of a picker lap, combed and cleaned in web form, and the web condensed and packaged in coiled sliver form into a can, a significant amount of cotton dust and lint is produced which tends to pollute both the environment of the carding machine and which can then be carried by the sliver to pollute subsequent operations within the textile mill. As is well known, cotton dust and lint are a matter of great concern to textile manufacturers and manufacturers of textile machinery. The Government has imposed guidelines regarding acceptable levels of cotton dust and lint in textile plants and various means are used at present in an attempt to comply with these guidelines and provide a safe environment for operators of textile machinery. However, to date even though various pneumatic and similar type apparatus may be used in combination with textile cards to reduce cotton dust, there is still a considerable amount of the cotton dust and lint which escapes from the machines. This can be evidenced by the fact that a typical operator can observe cotton dust and lint on the housing of his carding machine and that considerable dust can be found in the ambient air when measurements are taken.

Heretofore, attempts have been made to remove dust at the carding operation through the use of various types of pneumatic apparatus adapted to the carding machine. For example, U.S. Pat. No. 3,438,093 to Rutz discloses a card flat cleaning system comprising a high pressure chamber on one side of the card from which air is blown laterally across the arcuate chamber formed by the flats to a low pressure chamber positioned on the other side of the textile card. The dirty air is then drawn out of the low pressure chamber and recycles through a conduit and filter to a blower into the high pressure chamber. A hood is provided to enclose the continuous run of flats and two blow nozzles are fluidly connected to the high pressure chamber for blowing the air laterally across the arcuate chamber and parallel to the rotational axis of the card cylinder. The Rutz patent further discloses the utilization of blow pipes having air discharging jets placed in the neighborhood of the return bends of the continuous run or belt of flats. Suction inlets coextensive with the flats are placed outside of the return bend at each end of the continuous run of flats for removing the flat waste stirred up by the two blow pipes and each suction inlet fluidly communicates with the previously described low pressure portion of the flat cleaning system. A suction inlet extending into the converging space between the licker-in and feed roller also is provided for withdrawing dust-laden air from therebetween and conveying it into the system.

It is important to note that the patent to Rutz discloses a plurality of horizontally disposed blow nozzles for blowing air laterally across the arcuate chamber above the card. These blow nozzles in combination with the blow pipes disposed adjacent and within each return bend of the continuous run of flats are intended to remove cotton dust and waste from the arcuate chamber defined by the continuous run of flats and enclosed by the hood thereabove. However, this system inherently will not function to aid in pulling cotton dust and waste from within the working space between the main card cylinder and the operative lower run of flats, a primary function of the instant invention. In fact, the air blown through the blow nozzles in a lateral direction across the arcuate chamber will tend to maintain and even force the cotton dust and fibers to remain in the working area between the main cylinder and operative flat run due to the relatively higher air pressure in the arcuate chamber created by the lateral air flow. This relative high pressure effect is enhanced by the blow pipes disposed adjacent each return bend of the continuous run of flats. The Rutz system tends to clean the card flats but the lateral air pressure blown therethrough also, at least in part, defeats the entire purpose of a card flat cleaning system of removing a maximum amount of cotton dust and waste from the textile card and thereby the operating environment of the card room and subsequent processing operations in a textile plant.

SUMMARY OF THE INVENTION

The present invention is concerned with an improved apparatus to be utilized either alone or in conjunction with certain known pneumatic means for removing cotton dust and lint from a textile carding machine. Typical pneumatic dust removal equipment known in the trade include various suction devices positioned at the front and rear end of the textile card for removing cotton lint and dust generated at the entry of the cotton stock into the machine and at the exit of the cotton web from the machine prior to condensing and packaging into a coiler can.

The apparatus of the present invention is simple in construction and adaptation to the existing textile carding machine and is effective in that it not only removes cotton dust and lint from the interior of the continuous run of flats, but furthermore, and much more importantly, actually pulls cotton dust and waste from the working area of the textile card between the main cylinder and the operative run of flats. By pulling the cotton dust and lint from within the working surface of the card and transporting same to a remote collection and/or disposal location, the textile card and surrounding air is rendered considerably cleaner.

It is believed that the present invention will allow for the removal of previously required flat brushes located within the arcuate chamber defined by the run of flats and will maintain the flat chain and pulleys in a relatively clean state. Also "pepper trash" or fine trash that normally will not be removed by the carding process will be pulled out of the cotton fiber by use of the present invention. More importantly, the fine cotton dust and lint will be so effectively removed from the card that cotton dust and lint levels in the work area surrounding the card will be considerably reduced. Also, the level of cotton dust and lint in subsequent processing of the cotton will be reduced since the cotton sliver strand produced by the card will contain substantially lower levels of cotton dust and lint. Therefore, not only is the environment at the carding process stage improved, but also the environment of subsequent fiber processing stages is substantially improved.

The present invention is adapted for use with a card comprising a plurality of flats disposed in a continuous arcuate belt above the surface of a portion of the circumference of the main cylinder, the belt having a lower operative run adjacent a portion of the circumference of the main cylinder and a higher inoperative run which together form an arcuate open space therebetween. The card flat cleaning system comprises at least one suction hood disposed in the arcuate space adjacent to the lower operative run of flats and which is adapted to pull cotton dust and lint from the arcuate space or chamber and also from between said lower operative run of flats and the working space therebeneath. Suction means are provided which fluidly communicate with the suction hood for transporting the cotton dust and lint to a remote location, typically for collection and disposal thereof.

From the foregoing, it will be apparent that this invention has as one of its principle objects the provision of an apparatus for effectively removing cotton dust and lint from a textile carding machine and thereby substantially reducing cotton dust and lint levels in the environment of the machine and subsequent processing environments.

More particularly, the object of this invention is to provide a textile card cleaning apparatus for removing cotton dust and lint from within the arcuate chamber defined by the continuous run of flats and from the working space defined by the card cylinder and the operative run of flats disposed thereabove.

Another object of the invention is to provide an improved apparatus for cleaning cotton dust and lint from a textile card which is simple and inexpensive to install, can be easily adjusted, and can be easily removed for purposes of routine maintenance of the textile card.

A more general object of the invention is to provide a textile card cleaning apparatus which can be secured to a card either alone or in combination with many types of existing pneumatic cleaning systems so as to reduce the level of cotton dust and lint in textile processing operations.

DETAILED DESCRIPTION OF THE PREFERRED EMBODIMENT

Figure 1:
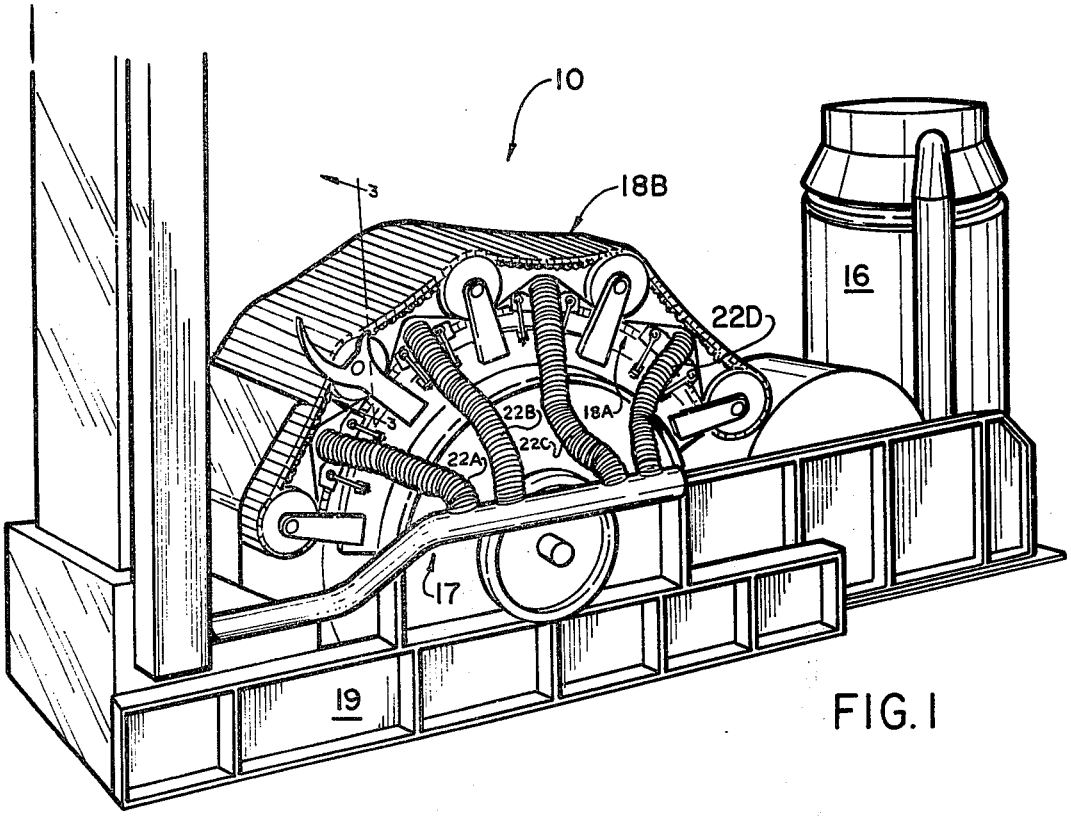
FIG. 1 is a perspective view of a textile card having the cotton dust and lint removal system embodying the present invention associated therewith.
Figure 2:
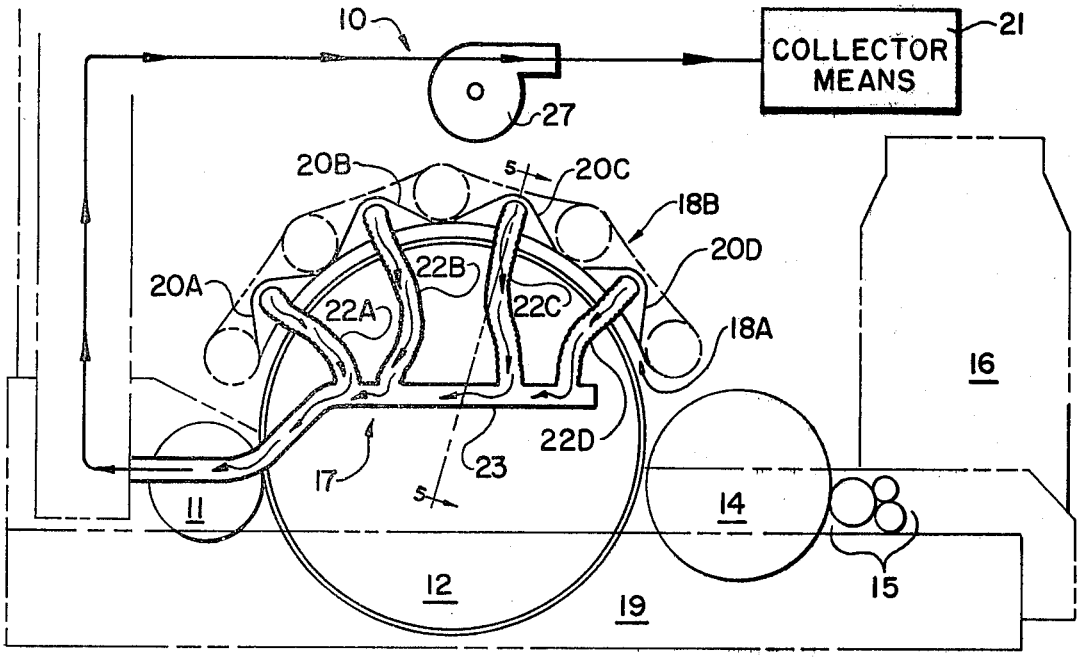
FIG. 2 is a diagrammatic vertical longitudinal section through the textile card and associated textile card cleaning apparatus.

Referring now more specifically to FIGS. 1 and 2 of the drawings, a textile carding machine including the textile card cleaning apparatus of the present invention is designated generally by the numeral 10. The textile card comprises a licker-in cylinder 11, a main cylinder 12, and a doffer cylinder 14 working in combination with a system of delivery rolls 15 to deliver processed cotton fiber strand to a coiler can 16. A continuous run of card flats is positioned above a portion of the circumference of the main cylinder 12 in a radially spaced apart relationship thereto and is comprised of a lower operative run of flats, generally designated 18*a*, which works in combination with the main cylinder 12 to clean and straighten cotton fibers being processed, and a higher inoperative run of flats 18*b*, generally designated, which move in the opposite direction and in a radially spaced-apart relationship to lower run 18*a*. A housing 19 is provided to support the card components described hereinbefore and to provide a collection bin therewithin for cotton waste such as cotton seeds and leaves which are removed from the fibers at carding.

The card cleaning apparatus of the present invention comprises a plurality of suction hoods 20*a*–20*d* fixedly secured within the space defined by the operative and inoperative runs of flats, 18*a* and 18*b* respectively. Suction means, generally designated 17, fluidly communicate with the suction hoods 20*a*–20*d* for pulling cotton dust and lint from the arcuate space defined by the continuous run of card flats and up through the spaces between the lower operative run of flats 18*a* from the work space therebeneath defined by main cylinder 12 and lower operative run of flats 18*a*. The cotton dust and lint removed by suction hoods 20*a*–20*d* are transported by suction means 17 to a remote collector means 21. The remote collector means 21 will typically collect the cotton dust and lint into a suitable form for disposal, and more specifically may typically take the form of a textile bale press room into which the conduit is fluidly connected and wherein the cotton dust and lint is baled together with other waste for subsequent disposal in landfills and the like.

The suction means 17 may typically be comprised of a flexible hose 22*a*–22*d* fluidly communicating with each of the suction hoods 20*a*–20*d* at one end thereof and at the other end thereof being secured to and fluidly communicating with a conduit 23 which extends to and fluidly communicates with remote collector means 21. A blower or air pump 27 provides the air flow by which the cotton dust and lint is removed by suction hoods 20*a*–20*d* from the textile card and transported by the suction means to remote collector means 21 for collection and disposal. A more detailed view of certain features of the preferred embodiment of the inventive card cleaning apparatus can be seen in the remaining figures.

Figure 3:
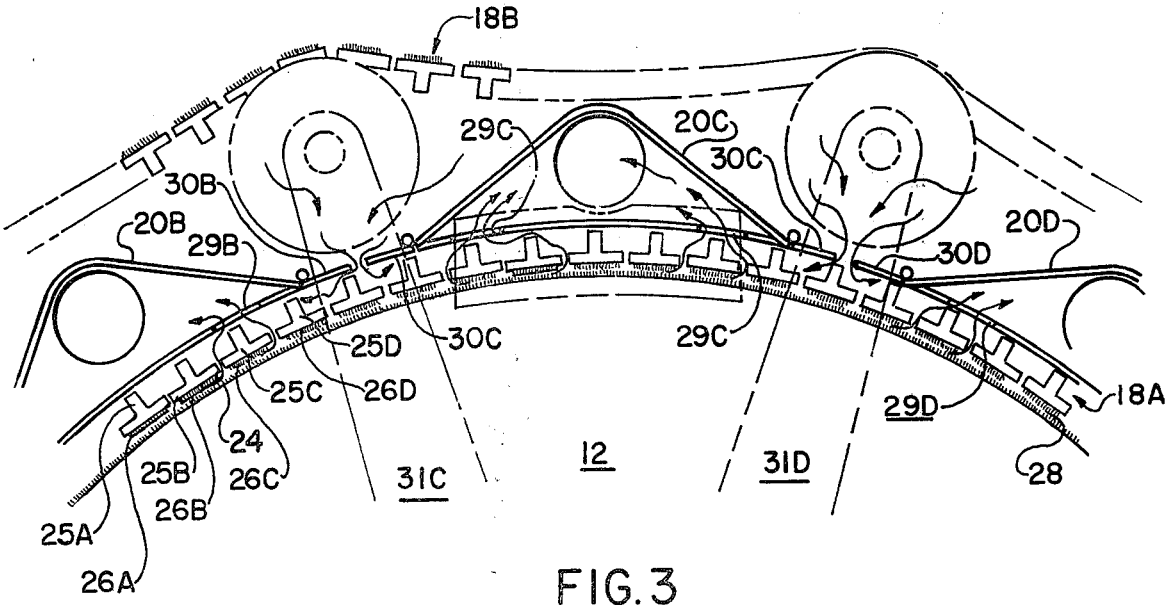
FIG. 3 is an enlarged fragmentary, sectional view taken as on the plane of line 3—3 of FIG. 1.

In FIG. 3, the relative location of suction hoods 20*a*–20*d* within the arcuate space defined by lower and upper runs of flats, 18*a* and 18*b* respectively, can be clearly seen. Furthermore, metallic clothing 24 can be observed which covers the entire circumferential surface of cylinder 12. Individual flats 25*a*–25*n*, of which the continuous belt of flats is partially comprised, can also clearly be seen. The flats 25*a*–25*n* also have a metallic covering 26*a*–26*n* which opposes metallic covering 24 of main cylinder 12 when the flats are disposed in the lower operative run and a working space 28 defined therebetween is the area in which the random tufts of cotton fibers are cleaned and arranged in a more parallel web-like form.

Figure 6:
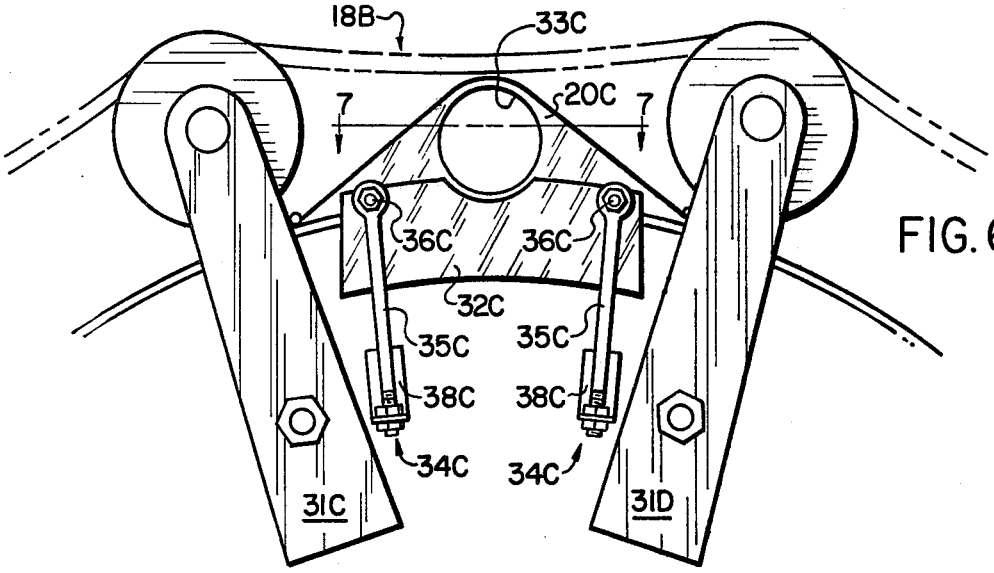
FIG. 6 is a side elevation view of an upper portion of a carding machine illustrating the adjusting means associated with the suction hoods of the present invention.
Figure 7:
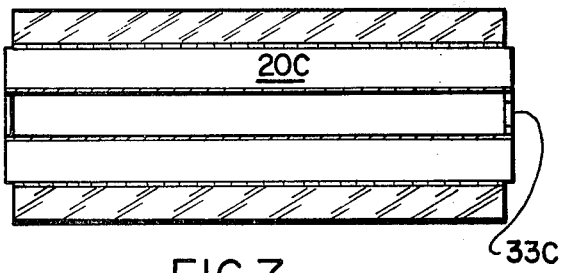
FIG. 7 is a transverse sectional view taken as on the plane of line 7—7 of FIG. 6.
Figure 8:
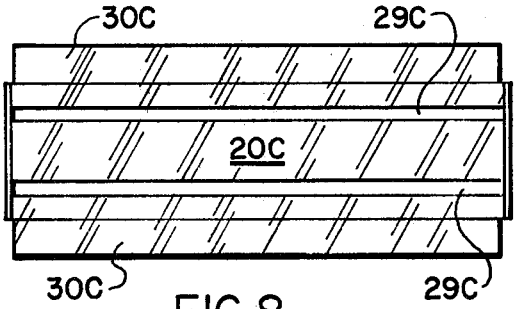
FIG. 8 is a bottom plan view of the suction hood illustrated in FIG. 7.

As is generally known in the textile industry, the height of the working space or, alternatively, the space between main cylinder metallic clothing 24 and flat metallic clothing 26*a*–26*n* is typically about 0.009 inches (0.023 centimeters). There is also a typical clearance between the longitudinal sides of card flats 25*a*–25*n* of about 0.040 inches (0.102 centimeters). The suction hoods are clearly seen to be of a generally triangular crosssectional configuration, typically about 3 inches (7.62 centimeters) in maximum height, and have two spaced-apart longitudinal slots 29*a*–29*d* (see also FIGS. 4,8) located in the bottom surface thereof. It is believed that the use of two slots, each having a width of about 0.5 inch (1.27 centimeters), will be functionally advantageous as the air velocity will be sufficiently great to pull cotton dust and lint from within the space defined by the continuous run of cotton flats and from within work space 28 up through the longitudinal spaces between individual flats 25*a*–25*n*. Each suction hood 20*a*–20*d* has a hole 33*a*–33*d* in one end wall thereof to which one of flexible hose 22*a*–22*d* is connected (FIGS. 6,7).

Suction hoods 20*a*–20*d* further include a pivotal plate 30*a*–30*d* (FIGS. 3,7 and 8) pivotally cooperating with at least one longitudinal side of the operative face of each of the suction hoods. These plates 30*a*–30*d* are intended to maximize the suction provided by suction hoods 20*a*–20*d* to the back side of the lower operative run of flats 18*a* so as to most efficiently pull cotton dust and lint from working area 28 therebeneath. Suction hoods 20*a*–20*d* are fixedly positioned about one-quarter inch (0.635 centimeters) above the back of operative run of flats 18*a* so as to allow the latter to move freely therebeneath. As best seen in FIG. 3, the suction provided by suction hoods 20*a*–20*d* results in a relatively high velocity of air flowing into longitudinal slots 29*a*–29*d* and will pull ambient cotton dust and lint from within the arcuate space defined by the continuous run of flats and will also perform the function of pulling cotton dust and lint from working area 28 up and between individual flats 25*a*–25*n* so as to clean this area. The latter is a most important function since cotton dust and lint not removed from the working space 28 may well be captured within the fiber web being processed and then be conveyed to subsequent winding and spinning operations or else escape into the environment surrounding the card.

Figure 5:
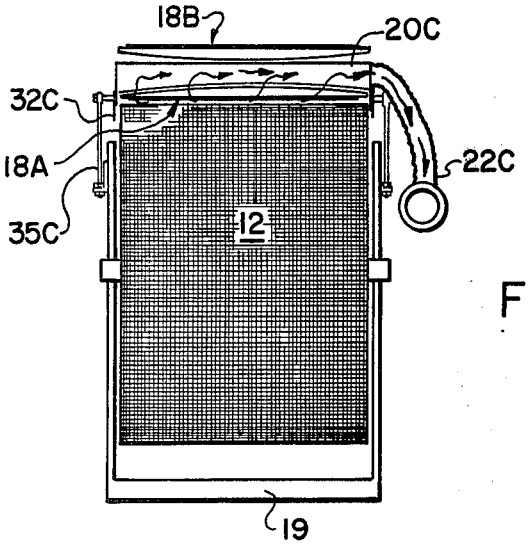
FIG. 5 is a vertical cross-sectional view taken as on the plane of line 5—5 of FIG. 2.

The cotton dust and lint is then pulled into suction hoods 20*a*–20*d* and is subsequently pulled therefrom through flexible hoses 22*a*–22*d* (FIGS. 1, 2 and 5) for conveyance to a remote collection point.

Figure 4:
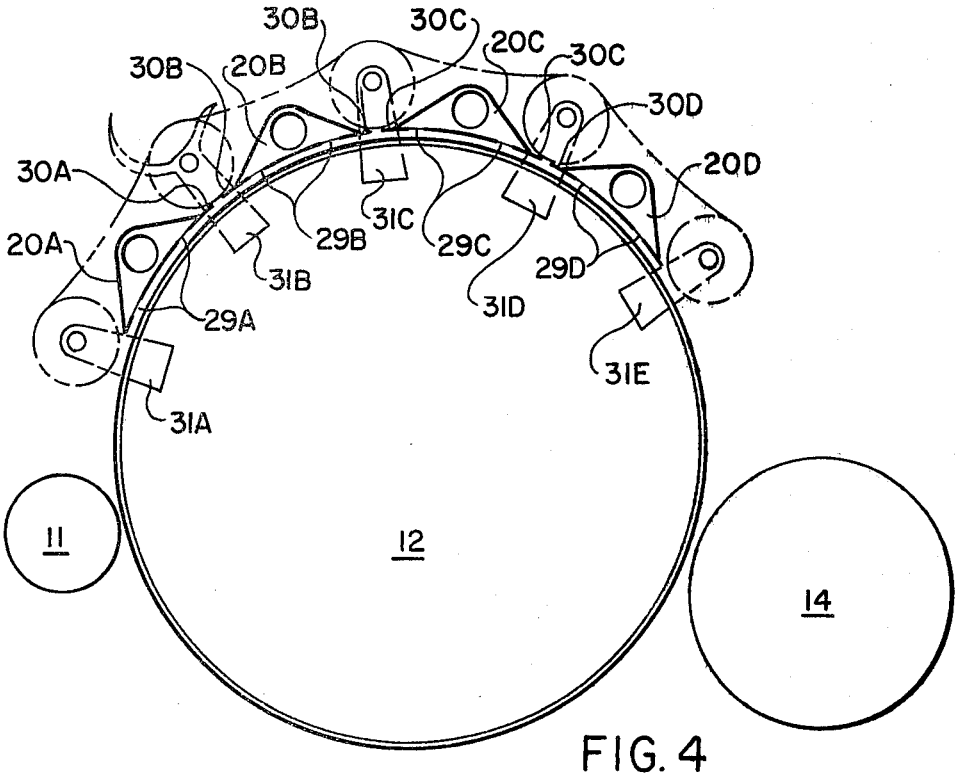
FIG. 4 is a side elevation view of a portion of a carding machine with parts broken away and including the associated portions of the present invention.

The arrangement of pivotal plates 30*a*–30*d* is best shown in FIGS. 3 and 4 of the drawings. Plates 30*a*–30*d* are pivotally connected to hoods 20*a*–20*d* by "piano" type hinges with stops so as not to allow the plates to pivot so far downwardly as to interfere in the movement of the lower run of flats. These plates, as previously noted, are intended to enhance the suction provided between suction hoods 20*a*–20*d* and the operative run of flats 18*a*. However, a further function is to provide a structure which will allow suction hoods 20*a*–20*d* to be easily unfastened and removed from the arcuate chamber defined by the continuous run of flats. As can be seen in FIG. 4, the individual plates can be pivoted upwardly toward a longitudinal side wall of each associated suction hood. By so doing, each of the suction hoods 20*a*–20*d* may then be removed in the direction of its longitudinal axis from between the flat pulley posts 31*a*–31*e*, seen best in FIG. 4.

As best seen in FIG. 6, suction hoods 20*a*–20*d* each have a removable side skirt or flinge 32*a*–32*d* depending downwardly from each end thereof so as to prevent the suction hood from shifting in its longitudinal direction. The downwardly depending side skirts 32*a*–32*d* extend beyond lower operative run of flats 18*a*. Also to be noted, each suction hood further includes fastening means, generally designated 34*a*–34*d* (FIG. 6), for adjustably securing the suction hood to the frame of the textile card. Typically, each fastening means 34*a*–34*d* comprises a pair of eye bolts 35*a*–35*d* secured to a pair of bolts 36*a*–36*d* on opposing sides of each end of suction hoods 20*a*–20*d*. The pairs of eye bolts are threadedly secured to pairs of "L" brackets 38*a*–38*d* which are secured to the housing of the textile card. The bolts 36*a*–36*d* on each suction hood further serve to secure side skirts 32*a*–32*d* to the opposite ends of each hood. Through the use of fastening means 34*a*–34*d*, it is possible to adjust suction hoods 20*a*–20*d* vertically relative to lower operative run 18*a* of flats. To remove each suction hood 20*a*–20*d*, all that is required is that the operator disengage fastening means 34*a*–34*d*, remove a side skirt at one end of each hood, preferably the side skirt secured to the remote end from the flexible hose so that the hose will not have to be removed also, pivot each of associated plates 30*a*–30*d* upwardly against the side wall of each suction hood 20*a*–20*d* and then pull each of the suction hoods in the direction of its longitudinal axis and out of the arcuate space defined by the continuous run of flats. It can be seen that it is not necessary to disassemble any operative portion of the textile card and that this operation can be accomplished in a quick and expeditious manner. This feature provides the inventive apparatus with an inherent flexibility and ease of removal which is not believed to be present in any prior art flat cleaning or dust removal systems.

Another possibility for use of the above-described invention would be in combination with any existing pneumatic cleaning equipment which may be presently adapted to the textile card. In this fashion, the present invention would enhance the effectiveness of such existing equipment. A typical modern card to which the inventive apparatus could be adapted would be a chute-fed card having pneumatic means cooperating therewith to clean the machine at the front and rear areas thereof contiguous to the lickerin and doffer cylinders. In this type of environment, it is anticipated that flexible hoses 22*a*–22*d* of the suction means communicating with suction hoods 20*a*–20*b* could be fluidly connected to existing vacuum ductwork extending to the machine. This would minimize installation cost of the inventive system described and claimed herein.

In operation, as explained earlier, the suction hoods will pull cotton dust and lint from the arcuate space in which they are disposed and from between flats of the lower operative run of flats and thereby remove cotton dust and lint from the working space between the main cylinder and the lower operative run of flats. The cotton dust and lint will be pulled from the suction hoods by a vacuum provided by a suction means and conveyed to a remote collection point at which the waste will be collected for disposal thereof.

It will thus be seen that there is provided an apparatus for simply and economically removing cotton dust and lint from within the working space of a textile card and the arcuate space defined by the continuous run of flats and conveying the dust and lint to a remote location for collection and disposal so as to substantially reduce the cotton dust and lint in the air in the environment in which the card operates.

In the drawings and specification, there has been set forth a preferred embodiment of the invention and, although specific terms are employed, they are used in a generic and descriptive sense only and not for purposes of limitation, the scope of the invention being defined in the claims.

I claim:

1. In combination with a textile card having a main cylinder, a plurality of flats disposed parallel to the longitudinal axis of said main cylinder in an arcuate continuous belt above the surface of a portion of the circumference of said main cylinder, said belt comprising a lower operative run movable adjacent the surface of a portion of the circumference of said main cylinder so as to form a working space therebetween and a higher inoperative run movable in the opposite direction and in a radially spaced-apart relationship to the lower run, the lower operative run and the higher inoperative run of the continuous belt of flats defining an arcuate open space therebetween, a card cleaning system for removing cotton dust and lint comprising: a plurality of suction hoods disposed within said arcuate open space adjacent to the lower operative run of said flats and adapted to pull the dust and lint from said arcuate space and from between said flats and the working space therebeneath during the lower operative run thereof; and suction means fluidly communicating with said plurality of suction hoods for removing the cotton dust and lint from the textile card to a remote location.

2. The combination according to claim 1 including means for adjusting each of said suction hoods relative to the operative run of said flats so as to allow for positioning of each of said suction hoods in close fluid proximity above the operative run of said flats but not in physical contact therewith.

3. The combination according to claim 1, wherein said suction means comprises a conduit fluidly interconnecting with each of said suction hoods and an air pump fluidly communicating with said conduit.

4. The combination according to claim 1 wherein each of said suction hoods is of a width coextensive with the width of the main cylinder, said suction hoods each having an enclosed generally triangular cross-sectional configuration with an operative surface wall disposed closely adjacent the operative run of said continuous belt of flats, each of said suction hoods further having a plurality of open, spaced-apart longitudinal slots in said operative surface wall for pulling cotton dust and lint from the working space between said main cylinder and said lower operative run of flats and from within said arcuate open space defined by said flats.

5. The combination according to claim 4 wherein the plurality of suction hoods are adapted to extend for the entirety of the circumference of said main cylinder which is adjacent the operative run of the continuous belt of flats.

6. The combination according to claim 5 wherein each of said suction hoods includes a pivotal plate extending from at least one longitudinal side defining the operative surface wall of each of said suction hoods, said pivotal plates serving to facilitate removal of said suction hoods from the arcuate open space defined by the flats.

7. In combination with a textile card having a main cylinder, a plurality of flats disposed parallel to the longitudinal axis of said main cylinder in an arcuate continuous belt above the surface of a portion of the circumference of said main cylinder, said belt comprising a lower operative run movable adjacent the surface of a portion of the circumference of said main cylinder so as to form a working space therebetween and a higher inoperative run movable in the opposite direction in a radially spaced-apart relationship to the lower run, the lower operative run and the higher inoperative run of the continuous belt of flats defining an arcuate open space therebetween, a card cleaning system for removing cotton dust and lint, comprising: a plurality of enclosed suction hoods disposed within said arcuate open space adjacent to the lower operative run of said flats and having a plurality of open, spaced-apart, longitudinal slots in the bottom surface thereof adjacent to the lower operative run of flats for pulling cotton dust and lint from said arcuate space and from between said flats and the working space therebeneath during the lower operative run of said flats; and suction means fluidly communicating with said plurality of suction hoods for transporting the cotton dust and lint from the textile card to a remote location.

8. A card cleaning system for removing cotton dust and lint from a textile card having a main cylinder, a plurality of flats disposed parallel to the longitudinal axis of said main cylinder in an arcuate continuous belt above the surface of a portion of the circumference of said main cylinder, said belt comprising a lower operative run movable adjacent the surface of a portion of the circumference of said main cylinder so as to form a working space therebetween and a higher inoperative run movable in the opposite direction and in a radially spaced-apart relationship to the lower run, the lower operative run and the higher inoperative run of said continuous belt of flats defining an arcuate open space therebetween, said card cleaning system comprising a plurality of suction hoods disposed in said arcuate open space adjacent to the lower operative run of said flats and adapted to pull the dust and lint from said arcuate space and from between said flats and the working space therebeneath during the lower operative run thereof, and suction means fluidly communicating with said plurality of suction hoods for transporting the cotton dust and lint from the textile card to a remote location.

9. A card cleaning system according to claim 8 including means for adjusting each of said suction hoods relative to the operative run of said flats so as to allow for positioning of each of said suction hoods in close fluid proximity adjacent and above the operative run of said flats but not in physical contact therewith.

10. A card cleaning system according to claim 8 wherein said suction means comprises a conduit, and an air pump fluidly communicating with said conduit.

11. A card cleaning system according to claim 8 wherein each of said suction hoods is of a width coextensive with the width of the main cylinder, said suction hoods each having an enclosed generally triangular cross-sectional configuration with an operative surface wall disposed closely adjacent the operative run of said continuous belt of flats, each of said suction hoods having at least one open, longitudinal slot in said operative surface wall for pulling cotton dust and lint from the working space between said main cylinder and said lower operative run of flats and from within said arcuate open space defined by said belt of flats.

12. A card cleaning system according to claim 11 wherein the plurality of said suction hoods are adapted to extend for the entirety of the circumference of said main cylinder which is adjacent the operative run of the continuous belt of flats.

13. A card flat cleaning system according to claim 12 wherein each of said suction hoods includes a pivotal plate extending from at least one longitudinal side defining the operative surface wall of each of said air suction hoods, said pivotal plates serving to facilitate removal of said suction hoods from the arcuate open space defined by the flats.

14. A card cleaning system for removing cotton dust and lint from a textile card having a main cylinder, a plurality of flats disposed parallel to the longitudinal axis of said main cylinder in an arcuate continuous belt above the surface of a portion of the circumference of said main cylinder, said belt comprising a lower operative run movable adjacent the surface of a portion of the circumference of said main cylinder so as to form a working space therebetween and a higher inoperative run movable in the opposite direction and in a radially spaced-apart relationship to the lower run, the lower operative run and the higher inoperative run of said continuous belt of flats defining an arcuate open space therebetween, said card cleaning system comprising a plurality of enclosed suction hoods disposed within said arcuate open space adjacent to the lower operative run of said flats and having a plurality of open, spaced-apart longitudinal slots in the bottom surface wall thereof next adjacent to the lower operative run of flats for pulling cotton dust and lint from said arcuate space and from between said flats and the working space therebeneath during the lower operative run of said flats, and suction means fluidly communicating with said plurality of suction hoods for transporting the cotton dust and lint from the textile card to a remote location for disposal thereof.

* * * * *